US009198542B2

(12) United States Patent
Frei

(10) Patent No.: US 9,198,542 B2
(45) Date of Patent: Dec. 1, 2015

(54) INTIMATE SHOWER FOR A WC

(75) Inventor: Christian Frei, Oberriet (CH)

(73) Assignee: PRESANO AG, Diepoldsau (CH)

( * ) Notice: Subject to any disclaimer, the term of this patent is extended or adjusted under 35 U.S.C. 154(b) by 257 days.

(21) Appl. No.: 13/879,987

(22) PCT Filed: Oct. 19, 2010

(86) PCT No.: PCT/CH2010/000262

§ 371 (c)(1),
(2), (4) Date: May 20, 2013

(87) PCT Pub. No.: WO2012/051724

PCT Pub. Date: Apr. 26, 2012

(65) Prior Publication Data

US 2013/0227775 A1 Sep. 5, 2013

(51) Int. Cl.

| | |
|---|---|
| ***A61H 35/00*** | (2006.01) |
| ***A47K 3/26*** | (2006.01) |
| ***E03D 9/08*** | (2006.01) |

(52) U.S. Cl.
CPC .... *A47K 3/26* (2013.01); *E03D 9/08* (2013.01)

(58) Field of Classification Search
CPC ..... A47K 3/26; E03D 9/08
USPC ..... 4/448, 443–447
See application file for complete search history.

(56) References Cited

U.S. PATENT DOCUMENTS

| | | | | |
|---|---|---|---|---|
| 4,242,764 A | | 1/1981 | Fukuda | |
| 4,287,618 A | | 9/1981 | Silver | |
| 4,841,582 A | * | 6/1989 | Matsui et al. | 4/420.1 |
| 5,359,736 A | * | 11/1994 | Olivier | 4/448 |
| 7,155,755 B2 | * | 1/2007 | Olivier | 4/447 |
| 2011/0107507 A1 | * | 5/2011 | Allard et al. | 4/420.4 |
| 2012/0304371 A1 | * | 12/2012 | Duvencioglu et al. | 4/448 |

FOREIGN PATENT DOCUMENTS

| | | | |
|---|---|---|---|
| DE | 599020 | C | 6/1934 |
| DE | 7725319 | U1 | 4/1979 |
| FR | 2304312 | A1 | 10/1976 |

OTHER PUBLICATIONS

English Translation of International Preliminary Report on Patentability dated May 7, 2013 in corresponding International Application No. PCT/CH2010/000262, Filed Oct. 19, 2010.

* cited by examiner

*Primary Examiner* — Huyen Le
*Assistant Examiner* — Christine Skubinna
(74) *Attorney, Agent, or Firm* — Rankin, Hill & Clark LLP

(57) ABSTRACT

This device for a combination shower-WC has a shower function and a blow-dry function. The shower function and the blow-dry function are incorporated in an arm (1) which can be retracted and extended by means of a control and which comprises, within an inner pipe (4), firstly at least one water supply line (2) leading to at least one shower opening (5), and secondly at least one air supply line (3) leading to at least one blow-dry opening (6), wherein a closure means is provided on the inner pipe (4) and, in the position for operating the at least one shower opening (5) with water, said closure means is arranged over the at least one blow-dry opening (6) and, in the position for operating the at least one blow-dry opening (6) with air, the closure means is moved away from the at least one blow-dry opening (6).

7 Claims, 2 Drawing Sheets

INTIMATE SHOWER FOR A WC

Figure 1A:
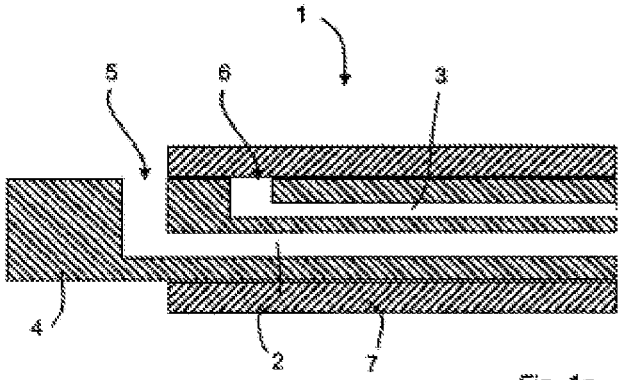

The present invention relates to a device for a shower WC.

It concerns a combination of a toilet with a bidet that makes possible a cleaning of the anus and/or of the vulva with water in a shower WC. Complete shower WCs and shower WC attachments that are mounted onto customary WC bowls are known.

Shower WCs are known in various constructions. The shower WC generally comprises a shower arm that can be extended and/or pivoted into the WC bowl. The shower arm is attached to a boiler. Warm water from the boiler can be supplied by a pump to the shower arm. Another element of the shower WC is generally a blow dryer whose air temperature can be regulated and whose operation can be turned on and off. The actuation of the shower arm and of the blow dryer takes place via a shower WC control that is operated via a control area comprising one or more switches or knobs and arranged in general on the side of the WC bowl for good accessibility or is operated by a remote control.

A combination of a seat bathtub, a seat shower and a bidet is known from U.S. Pat. No. 4,287,618 A in which a supply of water is provided via a spray head and a supply line of warm water via a warm air unit but without blow dryer arm.

A hygienic cleaning device is known from U.S. Pat. No. 4,242,764 A that comprises supply conduits and supply nozzles for warm air and nozzles for the supply of water.

The invention has the task of creating a device for a shower WC that improves the comfort of intimate hygiene.

The task is solved with the device in accordance with the features of claim 1.

This creates a device for a shower WC comprising a combined shower and blow dryer arm in which the combined shower and blow dryer arm is constructed in an arm that can be extended and refracted by a control.

The arm can comprise two water supply lines to two water-dispensing shower openings (anal or vulva hygiene) as well as one or more air supply line or lines to one or more air-dispensing blow dryer openings, whereby a closure is provided on the arm that is arranged in the position for the operating of the shower opening with water above the blow dryer opening, and which closure can be moved away from the blow dryer opening in the position for the operating of the blow dryer opening.

The construction of the shower and blow dryer arm in one and the same arm increases the comfort on account of the better possible arrangement since two arms do not have to be used, at least one of which must be arranged off-center. The central arrangement of the shower function as well as of the blow dryer function is possible with the one arm whereby the closure protects the blow dryer opening from entering water or contamination during the operation of the shower. The direction of the air jet of the blow dryer opening is optimal since it can run similar to the direction of the water jet. In addition, the expense for the mounting and/or maintenance and sealing is reduced since only one opening has to be provided in the ceramic material; the same drive and the same control can be used. In addition, the expense of the manufacture is reduced since only one unit has to be produced.

It can be provided that the closure is arranged in the position for operating the shower with water above the blow dryer opening in order to create a simple constructive possibility of reliably preventing a possible entrance of water into the blow dryer opening by mechanical means.

The closure can be constructed as an outer tube surrounding the inner tube, which makes a simple handling possible. Furthermore, a construction as a tubular element makes possible an adaptation to existing systems. The outer tube can have an opening that alternately frees or exposes the blow dryer opening or the shower opening.

It can be provided for a simple design of a control and of the mechanism for extending and retracting the combined shower and blower arm that the outer tube can be moved by the control between two (end) positions, whereby one of the two positions corresponds to the retracted position of the combined shower and blow dryer arm in the ceramic material of the shower WC. Therefore, the outer tube only has to be moved between two stop positions, whereby there is only the possibility of "retracted" (combined shower-blow dryer arm is not being used) and the possibility of "extended" (combined shower/blow dryer arm is being used).

It can be provided for a simple construction of the mechanism and of the control of the device of a combined shower/blow dryer arm that the inner tube can be moved into three different positions by the control. The three positions correspond to the positions "retracted" (shower-blow dryer arm is not being used), shower function is being used and blow dryer function is being used.

It can be provided that the two positions of the outer tube correspond to two positions of the inner tube, and the third position of the inner tube results from the fact that the inner tube is extended further out in comparison to the extended (end) position of the outer tube. This achieves an especially simple design of the mechanism and of the seal between the inner tube and the outer tube.

Instead of the two or three positions, several positions individually adapted to the user can also be provided.

It can furthermore be provided that the device in accordance with the invention is housed in a technical unit that has a front interface for mounting on a closet body and a rear interface for mounting on an installation surface on the building side.

It can furthermore be provided that the water supply line in the area of the shower opening and the air supply line in the area of the blow dryer opening run substantially parallel to one another.

Figure 1B:
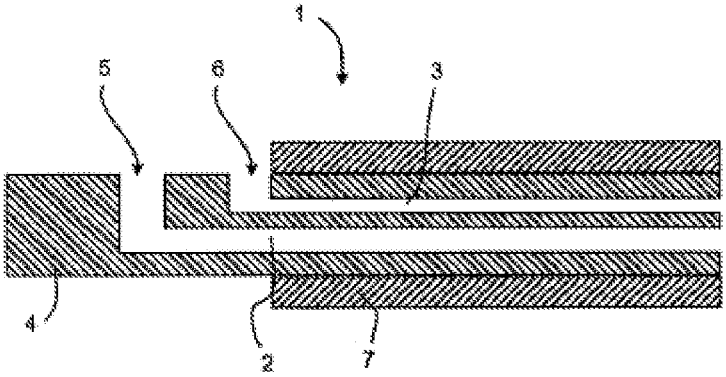
Figure 2A:
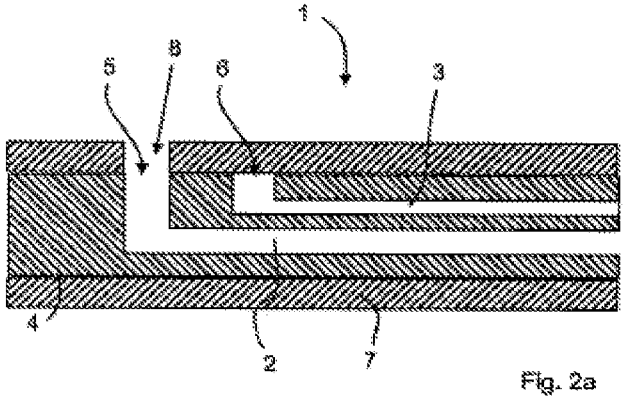
Figure 2B:
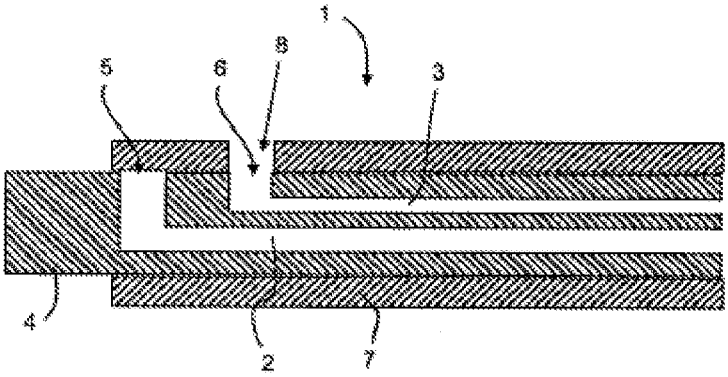

FIG. 1*a* schematically shows a device of a combined shower/blow dryer arm of a shower WC in accordance with the invention during use as a shower arm in a cross section in the longitudinal direction in a first embodiment;

FIG. 1*b* schematically shows the device in accordance with the invention in FIG. 1*a* during use as a blow dryer arm in a cross section in the longitudinal direction;

FIG. 2*a* schematically shows another embodiment of a combined shower/blow dryer arm of a shower WC during use as a shower arm in a cross section in the longitudinal direction;

FIG. 2*b* schematically shows the embodiment of FIG. 2*a* during use as a blow dryer arm in a cross section in the longitudinal direction.

FIGS. 1*a* and 1*b* schematically show a device for a shower WC comprising a combined shower arm and a blow dryer arm. The combined shower and blow dryer arm are constructed in an arm 1 that can be retracted and extended by a control of the shower WC. The control can be the control of the shower WC embodied by a microprocessor. The arm 1 comprises a water supply line 2 and an air supply line 3 that is separate from the water supply line 2 and in the form of passages and conduits in an inner tube 4 of the arm 1.

The water supply line 2 is connected to a container (not shown) in which water can be warmed or heated. The water supply line 2 can be loaded via a pump (not shown) with the water from the container.

The water supply line 2 discharges from the inner tube 4 in a shower opening 5 for the shower function, whereby the shower opening 5 can comprise a shower nozzle. The air supply line 3 discharges from the inner tube 4 in a blow dryer opening 6 that can be provided with a blow dryer nozzle. The air supply line 3 can be supplied or loaded via an air compressor (not shown) with preferably warm compressed air.

The inner tube 4 is surrounded by a closure that is arranged above the blow dryer opening 6 (see FIG. 1*a*) in the position for operating the shower opening 5 with water and is removed from the blow dryer opening 6 in the position for operating the blow dryer opening 6 with air (see FIG. 1*b*).

In the embodiment shown in FIGS. 1*a* and 1*b* the closure is constructed as an outer tube 7 surrounding the inner tube 4, the inner diameter of which outer tube is adapted to the outer diameter of the inner tube 4 in order to achieve a precise fit. The outer tube 7 can be coated on its inner surface with an elastic material in order to make possible a precisely fitting sliding of the inner tube 4 on the outer tube 7 and to seal the inner tube 4 to the outside with the outer tube 7 surrounding it.

The outer tube 7 and the closure can be moved between two positions by the control, whereby the one position corresponds to a refracted position. The combined shower/blow dryer arm is in retracted into the ceramic material of the shower WC. In the a position of the outer tube 7 the combined shower/blow dryer arm can be used. It is extended in the other position into the ceramic material and thus exposed in the WC bowl of the shower WC.

The inner tube 4 can be moved into three different positions by the control, on the one hand the retracted position, in which the combined shower/blow dryer arm is lowered in the ceramic material and on the other hand into two other positions that correspond to the to the shower function and the blow dryer function. FIG. 1*a* shows one of the two latter positions in which the shower opening 5 is exposed. The relative position of the inner tube 4 and of the outer tube 7 are retained for the retracted position. The inner tube 4 and the outer tube 7 are extended into the WC bowl. The control supplies the water supply line 2 with water in the position shown in FIG. 1*a* in order to carry out or make possible the shower function. Instead of the two or three positions several positions individually adapted to the user can also be provided.

In contrast to FIG. 1*a* in FIG. 1*b* the inner tube 4 is extended further out relative to the outer tube 7 in order to carry out or make possible the blow dryer function. In the position shown in FIG. 1*b* the control supplies the air supply line 3 with warm compressed air and blocks the water supply for the water supply line 2.

In the state of the arm 1 retracted into the ceramic material the blow dryer opening 6 is closed, which prevents the entrance of water and contamination into the blow dryer opening 6 during the preliminary and subsequent washing. The inner tube 4 and the outer tube 7 have the relative position to one another shown in FIG. 1*a*. For the shower function the inner tube 4 and the outer tube 7 extend jointly out without changing the relative position to one another.

The FIGS. 2*a* and 2*b* show another embodiment in which the same reference numerals designate the same elements as in the embodiment shown in FIGS. 1*a* and 1*b*. Furthermore, the closure is constructed in such a manner in the embodiment shown in FIGS. 2*a* and 2*b* that it is arranged above the blow dryer opening 6 in the position for the operation of the shower with water in order to ensure when carrying out the shower function that no water can pass from the shower opening 5 into the blow dryer opening 6.

The outer tube 7 has an opening 8 that alternately exposes the blow dryer opening 6 or the shower opening 5 to the inner tube 4 in the two relative positions of the outer tube 7 shown in FIGS. 2*a* and 2*b*.

FIG. 2*a* shows the relative position of the outer tube 7 to the inner tube 4 in which the shower opening 5 is exposed. The control can supply the water supply line 2 with water in the position shown in FIG. 2*a* in order to carry out or make possible the shower function of the combined shower/blow dryer arm.

In contrast to FIG. 2*a* in FIG. 2*b* the inner tube 4 with the blow dryer opening 6 is extended further relative to the outer tube 7 in order to carry out the blow dryer function and to expose the blow dryer opening 6. In the position shown in FIG. 2*b* the control can supply the air supply line 3 with preferably warm compressed air and block the water supply for the water supply line 2.

The blow dryer opening 6 is closed in the state of the embodiment of the arm 1 shown in the FIGS. 2*a* and 2*b* and retracted into the ceramic material, which prevents the entrance of water into the blow dryer opening 6. The inner tube 4 and the outer tube 7 have the relative position to one another shown in FIG. 2*a*. For the shower function the inner tube 4 and the outer tube 7 extend jointly without changing the relative position to one another.

As previously described, the present invention makes possible a better arrangement of an arm for a shower WC with a shower function and a blow dryer function since two arms are not used, at least one of which must be arranged off-center. A central arrangement of the shower arm as well as of the blow dryer arm is possible with the one arm. The direction of the air jet is optimal since it can run similar to the direction of the water jet. In addition, the expense for the mounting and/or maintenance and sealing is reduced since only one opening has to be provided in the ceramic material; the same drive and the same control can be used.

The invention claimed is:

1. A device for a shower WC comprising a retractable and extendable arm containing a shower function and a blow dryer function, wherein the comprises an inner tube containing:

at least one water supply line to at least one shower opening; and at least one air supply line to at least one blow dryer opening;

wherein a closure in a form of an outer tube that surrounds the inner tube is provided on the inner tube, wherein the closure is movable longitudinally relative to the inner tube between a first position and a second position, wherein, in the first position, the closure covers the at least one blow dryer opening thus prohibiting air in the at least one air supply line to flow out of the at least one blow dryer opening but does not cover the at least one shower opening thus allowing water in the at least one water supply line to flow out of the at least one shower opening, and wherein, in the second position, the closure does not cover the at least one blow dryer opening thus allowing air in the at least one air supply line to flow out of the at least one blow dryer opening.

2. The device according to claim 1, wherein the closure covers the at least one shower opening in the second position thus prohibiting water in the at least one water supply line to flow out of the at least one shower opening.

3. The device according to claim 1, wherein the outer tube has an opening, and wherein either the blow dryer opening or the shower opening is exposed via the opening in the outer tube when the outer tube moved longitudinally relative to the inner tube alternately between the first position and the second position.

4. The device according to claim 1, wherein the outer tube is movable between a retracted position and an extended position.

5. The device according to claim 1, wherein the inner tube is movable relative to the outer tube.

6. The device according to claim 4, wherein the retracted position and the extended position of the outer tube correspond to one of the first position and the second position, respectively, of the closure relative to the inner tube, and wherein the inner tube is movable further into a third position relative to the extended position of the outer tube.

7. The device according to claim 1, wherein the water supply line, in an area of the shower opening, and the air supply line, in an area of the blow dryer opening, run substantially parallel to one another.

* * * * *